US006656091B1

(12) United States Patent
Abelbeck et al.

(10) Patent No.: US 6,656,091 B1
(45) Date of Patent: Dec. 2, 2003

(54) EXERCISE DEVICE CONTROL AND BILLING SYSTEM

(76) Inventors: Kevin G. Abelbeck, 2524 S. Sepulveda Blvd., #302, Los Angeles, CA (US) 90064; John A. Casler, 1875 S. Beverly Glen, #107, Los Angeles, CA (US) 90025

( * ) Notice: Subject to any disclaimer, the term of this patent is extended or adjusted under 35 U.S.C. 154(b) by 0 days.

(21) Appl. No.: 09/556,762

(22) Filed: Apr. 21, 2000

(51) Int. Cl.[7] ..... A63B 71/00
(52) U.S. Cl. ..... 482/9; 482/8; 482/1
(58) Field of Search ..... 482/1–9, 51, 54, 482/57, 900–902

(56) References Cited

U.S. PATENT DOCUMENTS

| | | | |
|---|---|---|---|
| 4,112,928 | A | 9/1978 | Putsch |
| 4,184,678 | A | 1/1980 | Flavell et al. |
| 4,283,712 | A | 8/1981 | Goody |
| 4,358,105 | A | 11/1982 | Sweeney, Jr. |
| 4,408,613 | A | 10/1983 | Relyea |
| 4,675,515 | A | 6/1987 | Lucero |
| 4,817,940 | A | 4/1989 | Shaw et al. |
| 4,828,257 | A | 5/1989 | Dyer et al. |
| 4,860,763 | A | 8/1989 | Schminke |
| 4,907,795 | A | 3/1990 | Shaw et al. |
| 4,911,427 | A | 3/1990 | Matsumoto et al. |
| 4,998,725 | A | 3/1991 | Watterson et al. |
| 5,056,141 | A | 10/1991 | Dyke |
| 5,098,089 | A | 3/1992 | Harrington et al. |
| 5,142,358 | A | 8/1992 | Jason |
| 5,329,590 | A | 7/1994 | Pond |
| 5,387,164 | A | 2/1995 | Brown, Jr. |
| RE34,872 | E | 3/1995 | Lucero |
| 5,412,575 | A | 5/1995 | Constant et al. |
| 5,440,109 | A | 8/1995 | Hering et al. |
| 5,481,463 | A | 1/1996 | Constant et al. |
| 5,581,463 | A | 12/1996 | Constant et al. |
| 5,598,477 | A | 1/1997 | Berson |
| 5,625,690 | A | 4/1997 | Michel et al. |
| 5,640,953 | A | 6/1997 | Bishop et al. |
| 5,655,997 | A | 8/1997 | Greenberg et al. |
| 5,706,822 | A | 1/1998 | Khavari |
| 5,713,350 | A | 2/1998 | Yokota et al. |
| 5,785,631 | A | 7/1998 | Heidecke |
| 5,785,632 | A | 7/1998 | Greenberg et al. |
| 5,787,156 | A | 7/1998 | Katz |
| 5,810,747 | A | 9/1998 | Brudny et al. |
| 5,822,415 | A | 10/1998 | Gordon |
| 5,835,576 | A | 11/1998 | Katz |
| 5,947,869 | A | 9/1999 | Shea |
| 6,004,243 | A | 12/1999 | Ewert |
| 6,450,922 | B1 * | 9/2002 | Henderson et al. ..... 482/8 |
| 6,503,173 | B2 * | 1/2003 | Clem ..... 482/8 |

OTHER PUBLICATIONS

Physical Genius Hone Trainer.
See attachement for scientific reference 1–13.

* cited by examiner

*Primary Examiner*—Glenn E. Richaman

(57) ABSTRACT

An exercise method is disclosed that includes at least one exercise device with at least one sensor and a method of information transfer between the exercise device and a user. This information transfer is likely accomplished by use of a computer monitor and some sort of input device such as a keypad. This can be combined by use of a touch screen monitor. The user is identified to the machine and a specific exercise protocol is generated and used to control the exercise session(s) on each machine being used. Sensory data is generated from each sensor on each exercise device, during each exercise session and used to generate a new protocol for the user's next exercise session. This new protocol is based on the user's performance on the previous exercise session. The information may also be compiled in a user-friendly format that the user can access via the internet or other multi-accessible information transfer system. This compiled data is a great motivational tool in promoting long-term physical fitness. In addition, a pay-per-use billing method is also disclosed to enable cost effective use of the disclosed.

30 Claims, 10 Drawing Sheets

EXERCISE DEVICE CONTROL AND BILLING SYSTEM

BACKGROUND OF THE INVENTION

The invention herein relates to fitness and exercise devices and more specifically to an information feedback and method of controlling an exercise device, the method including a billing process for use of the device.

With the increased awareness of the beneficial effects of physical exercise on the human body, attempts are being made to make exercise more desirable and effective for the user. Unlike many products and services, the fitness field requires consistent use before significant results can be realized. As such, the effectiveness of the fitness product or service is greatly determined by usage. The use of any product is directly correlated to motivations of the user. In the case of fitness, a major contributing factor in motivating the user is positive results and just as importantly, the realization of those positive results. Therefore, two aspects are vitally important in producing an effective fitness system, first, the effectiveness of the device or training program, and second, the ability to provide a feedback of this information back to the user in an understandable format.

The combination of training effectiveness and information feedback is self-perpetuating in that if a user begins an exercise regime and has documented positive results, the user is encouraged to continue the program. This in turn results in further positive results. Thus, an advantageous cycle continues. Without this combination, many user's fitness programs fade away, as with so many good intentions.

Scientific justification exists showing aspects of training that result in these positive results. For the sake of this disclosure, positive results will be interpreted as any single or a combination in the five components of physical fitness as documented by Heyward (Heyward, V. H., 1984). These include:

1. Cardiorespiratory Endurance;
2. Muscular Strength and Endurance;
3. Body Weight and Composition;
4. Flexibility; and
5. Neuromuscular Relaxation.

The first four components are stressed in the evaluation of a fitness program in that they are predominantly more definitive to the user regarding the desired results of a fitness program.

Cardiorespiratory endurance is commonly measured in the amount of oxygen the body can consume in a given time. This is referred to as the $VO_{2\ max}$, typically reported in ml/kg/min. This is the maximal volume, or millimeters of Oxygen, that a subject can consume per kilogram of body weight, per minute. The greater the $VO_{2\ max}$ the greater the cardiorespiratory endurance. Normal healthy ranges vary from 40 to 80 ml/kg/min depending upon conditioning level and other physiological parameters.

Muscular strength is typically measured in a 1RM, or maximal exertion, in pounds or Newtons, the user can lift in one repetition. Muscular endurance is the ability of the muscle to repeatedly perform under sub-maximal conditions, 15–30 or more repetitions of a particular movement. Again, the greater the number of repetitions performed, the greater the muscular endurance.

An increase in muscular size and/or a decrease in body fat, would constitute an improvement in body composition.

This is usually reported as a percentage of total weight that is fat weight, or a percent body fat (%BF). Not only does the %BF decrease as the fat weight decreases, but as the lean weight or muscle weight increases, the percent of the total weight which is fat weight, decreases. Therefore because most American's carry excessive fat weight, an increase in fitness is here designated as a decrease in %BF. An increase in the joint range of motion (ROM) is considered to be an increase in flexibility. This is particularly common in the case of recovery from injury. Localized inflammation after injury restricts joint movement. This is likely an evolutionary advantage in that inflammation necessitates inactivity, which is temporarily desirable for healing. As a part of total recovery, total (pre-injury)joint range of motion is desired. This is done by incrementally increasing the movement of the joint, during rehabilitation, under a resistive or "loaded" condition, as would be the case with an exercise machine. An increase in ROM is considered to be an increase in this fitness level.

For an exercise program to be effective and achieve positive results as previously specified, certain parameters must be followed, as is suggested in the scientific literature. An increase in $VO_{2\ max}$ as a result of endurance training has been found (Fox, E., et al, 1977; Fox, E., et al, 1973; Frick, M, et al, 1970 and Henriksson, J. et al, 1977). This teaches us not only the value of exercise as a means of obtaining increased cardiorespiratory endurance, but the increased effectiveness related to the intensity of training. To a degree, results are better realized by a higher intensity of training. Overtraining is a problem that is commonly associated with a predisposition to injury and among other things, decreased performance, sleep problems and a loss of appetite (Callister, R, et al, 1990, Budgett, R., 1990 and Warren, B. J., et al, 1992). Appetite is critically important in that nutrients are even more essential to the body to recover in this state. With a decreased food intake, serum concentrations are also lowered. Overtraining is a potential with all forms of activity.

Increases in muscular strength from resistance training have been shown scientifically as early as 1897 (Morehouse, C., 1967). In addition, flexibility and hypertrophy (Stone, M. H., et al, 1981) have also been documented through resistance training. To focus on any one aspect over the others, a specific training regime must be adapted. Variations in muscle fiber types (Schmidtbleicher, D., et al, 1981 and Gollnick P. D. et al, 1973) stimulated by various training principles, and biochemical adaptations (Karisson, J. L., et al, 1972) make specificity of training paramount in not only training an athlete but in the interest of user motivation of the general public as well.

In terms of gaining maximum strength (Stone, M. H., et al, 1981 and Schmidtbleicher, D. et al, 1981) and maximum muscle hypertrophy (Stone, M. H., et al, 1981), one consistency is the importance of training intensity. This "overload" principle, as first stated by L. Lang in 1919, has been documented for many years for increased strength and endurance. In order to optimize these adaptations, close monitoring of performance must be maintained in order to set the proper resistance because the number of repetitions per set varies depending upon the desired effect (Stone, M. H., et al, 1981).

With the technology of today, capability exists to grant the user greater capability to reap the benefits of the research of yesterday. The capture and evaluation of individual data with the aid of modern technology enables sophistication of individualized exercise prescription, with constant updating capabilities that is not possible with a human coach or trainer and traditional equipment. The limitation in some aspects would be the cost of development and implementation of such a system. Use by many would-be patrons would likely be precluded due to these development and manufacturing costs. What is needed is a system offering the capabilities as described and presented it in a package that is affordable to the individual.

SUMMARY OF THE INVENTION

Present Invention

In one aspect, the disclosed provides a method of controlling an exercise device with at least one sensor, the exercise device being adapted to enable information transfer between a user and the exercise device. The disclosed also includes the process of identifying the user and providing an exercise protocol specifically for that user. The exercise device is then controlled in accordance with the provided exercise protocol throughout the exercise session. Data is then gathered from the sensor, or many sensors as the case may be, and a new protocol is generated in accordance with the information gathered from the sensor. The new protocol then replaces the former exercise protocol in preparation for the next exercise session.

It is understood that in some cases, such as when a qualified individual is in a supervisory position, such as a physician, physical therapist, coach, trainer or the like, the system will enable these personnel to modify the exercise protocol if deemed desirable for the user. In such cases, the method as disclosed, provides the basis of each new exercise protocol and the supervising authority can override the protocol and "tweak" it. The system may also include a billing system that includes one or more billing steps in which the user is directly billed by a pay-per-use fee for use of the device and system. The user's personal account or a credit card can be billed as would be a personal trainer or coach for training the individual for each exercise session. The billing sequence may be broken down into multiple steps, each step constituting an integral part of the associated cost associated with such a system.

In another aspect, the invention includes the process of compiling at least some portion of the data obtained from the one or more sensors on the exercise device. The relevant data is then placed in a user-friendly format and made accessible to the user. This can be done by means of any multi-accessible information transfer system such as an internet, a local area network (LAN) or an intranet system. The user can then access this information and review their training progress. This ability to realize improvements in training performance is a highly motivational tool in enabling the individual to reap the rewards of the long-term benefits of exercise.

Definition of Terms

Unless otherwise defined, all technical and scientific terms used herein have the same intended meaning as would be commonly understood by anyone of ordinary skill in the art to which this invention belongs. To eliminate possible ambiguity, specific terms used herein are defined as they would be applied to the present invention.

An "Exercise Device" is any machine or apparatus that enables a user to perform physical work thereon. This includes strength training equipment, cardiovascular training equipment and stretching equipment.

A "Exercise Sequence" is a portion of one exercise session that comprises the use of any particular exercise device. This is one or more exercise bouts, or sets, on that device.

An "Exercise Session" is one complete training session or workout using one or any combination of exercise devices. An exercise session may be comprised of one or more machine sequences.

An "Exercise Protocol" comprises a detailed account of the proposed exercise session. Such detail may include exercise workload, which may include load values of each concentric and eccentric repetition, the anticipated number of repetitions per device, what specific exercise devices will be used in any particular exercise session, and the duration of the use of one or more devices.

"Exercise Workload" is a generic measure of the work performed by a user during an exercise session. This can be the amount of load used times the sum of the distance moved, or in the case of a cardiovascular conditioning product such as a bike, the speed times the crank torque times the duration.

DETAILED DESCRIPTION OF THE PREFERRED EMBODIMENT

The object of the disclosed invention is to provide an improved method of generating an exercise protocol by gathering information relative to the performance of an individual. This is done to optimize the training efficiency of the individual, thereby maximizing the desired effects of physical exercise for each training session. The system can involve a single exercise device or multiple devices, each in communication with an information control system. This information control system is multi-accessible and allows the user to access their individual data to access their performance over time. This is a highly motivational tool for the user, in that it shows improvement toward a goal. In order that this sophisticated system can be made affordable to the general public, a novel pay-per-use payment system is also disclosed.

Figure 1:
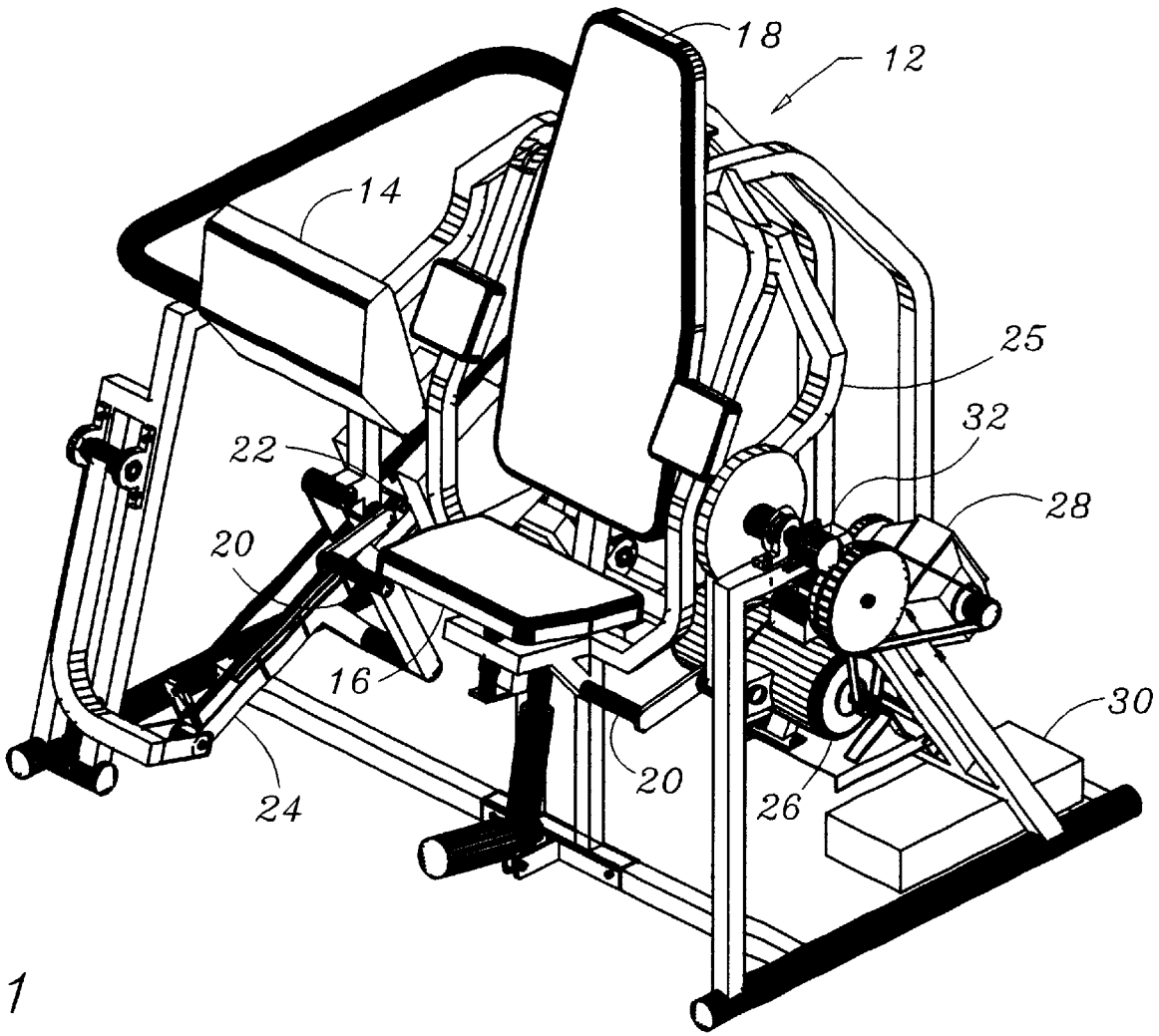
FIG. 1 is an example of an exercise device in the form of an arm curl, the device produced in accordance with the preferred embodiment of the present invention.

Referring to the drawings, FIG. 1 shows an example of an exercise device that has been adapted to include the process for controlling, as described herein. The device 12, here as an arm curl machine, is equipped with a touch screen display 14 which enables information transfer between a user and the device 12, in that information is displayed to the user by way of the screen and the user can input information by touching portions of the screen in response to a visual que as presented on the screen. This touch screen technology is used in accordance with the preferred embodiment, but any form of information transfer would be acceptable in this application.

As a user positions themselves on the bottom seat 16 with their back against the back seat 18, the handles 20 are grasped and rotated upward, bending at the elbow. This causes a concentric contraction of the biceps muscles of the upper arms of the user. The force applied is due to the vertical movement of the weight 22 located on the weight arm 24, that is in turn connected to an exercise arm 25 which supports the handles 20. A drive motor 26 supplies torque to the exercise arm 25 by way of the clutch 28 to increase or decrease the resultant force required at the handles 20.

After flexion of the elbow is completed, the handles are then lowered under tension, resulting in an eccentric movement phase of the biceps muscles. Modification of the load applied to the handles is made by altering the direction and/or torque output of the motor 26, or clutch 28, or movement of the weight 22 on the weight arm 24. Control of these processes is made by a microprocessor 30, as shown here in the device 12. Load applied can be measured directly by use of load cells in the handles 20 or by calculation of approximate load as determined by the device parameters as previously defined.

The load cells would be one example of a sensor on the device. Another would be a position sensor, as shown here to be a rotary sensor 32. This rotary sensor 32 is in communication with the microprocessor 30, and is attached to the exercise arm 25. A common feature of the microprocessor is the function of time, thus with the information from the rotary sensor 32, information regarding position, speed and acceleration of the handles 20 can be determined. This information integrated with the load, measured or calculated, yields work done, and power output. These are some of the information parameters that can be stored and compiled in a user-friendly format that can be later viewed by the user.

This is only one example of one machine that can be used in this application. Other strength machines could just as easily be used. In cases where the user's feet interact with the machine, a foot-plate or its equivalent would replace the handles 20. In each machine that is designed to work a different muscle group, the design of the machine itself would change but the generic function would remain.

Cardiovascular machines such as treadmills, bikes, steppers and rowing machines, to name a few, could employ a system that senses, and stores information that is relevant to the performance of the user during the exercise session. With cardiovascular products, load, duration and speed are typically deemed relevant in relation to heat rate in estimating oxygen consumption. This is an estimate of cardiorespiratory endurance or fitness of the user. For example, on a treadmill, along with heart rate, speed, duration and inclination of the running surface would be included as relevant information. On a bike, crank torque, speed and duration are included as relevant information.

Numerous methods are currently available to measure or estimate heart rate. Heart rate monitors are common in the industry, and can be incorporated into the exercise device 12 to monitor and store heart rate without disturbing the user. The old standby is also possible, where the user counts their heart rate and enters this number into the input device on the exercise device 12. Any such device or method is not considered limiting to the scope of the disclosure.

Figure 2:
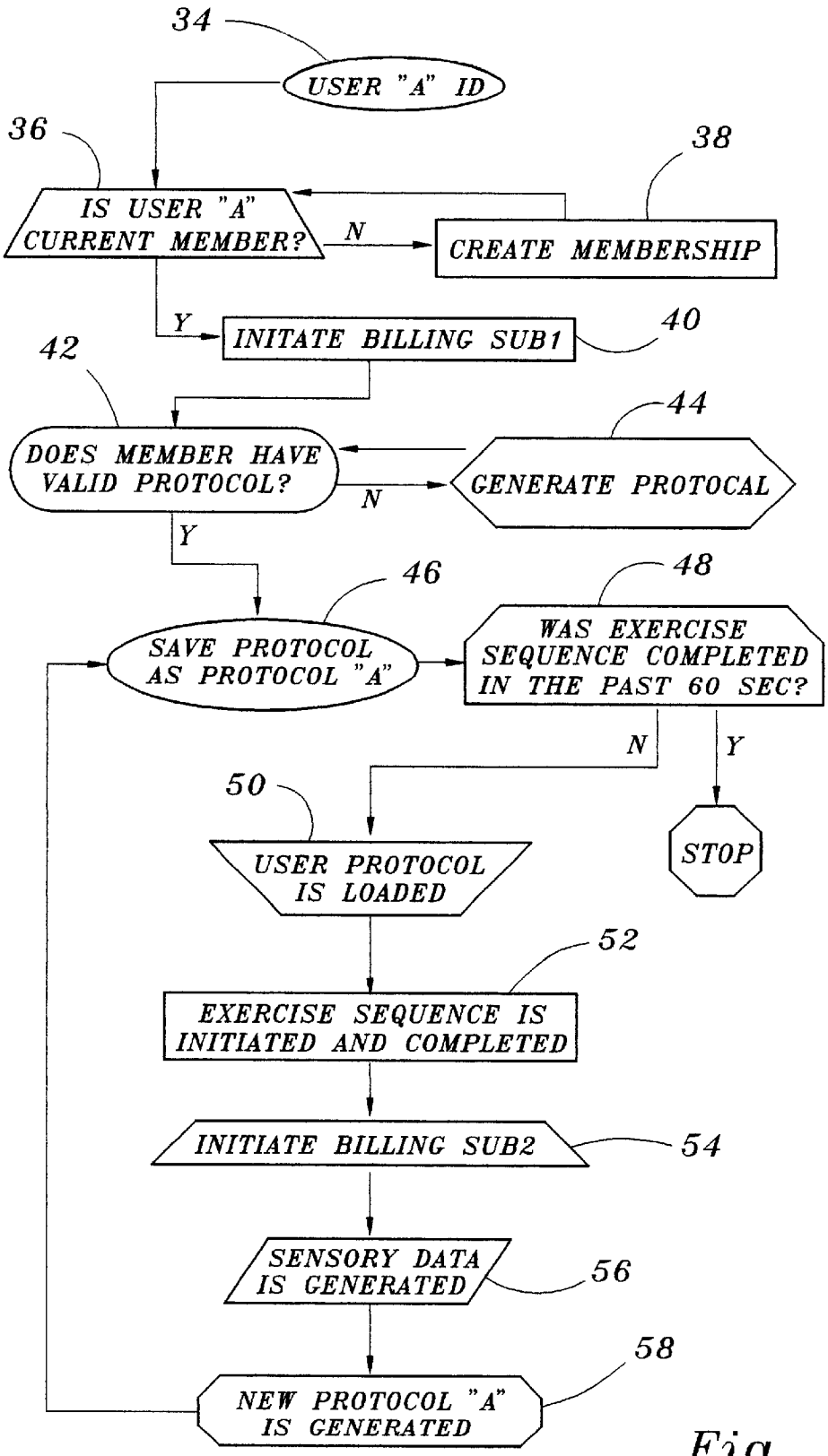
FIG. 2 is a flowchart illustrating the steps involved in the use of the process of controlling an exercise machine in accordance with the preferred embodiment of the present invention.

What is shown in FIG. 2 is a flow chart of a method of using the aforementioned information to determine an optimal exercise protocol for the user. Here a specific user is identified as user "A". This step 34 is likely performed by a personal identification number (PIN) that the user inputs into the system by way of the display 14 as shown in FIG. 1. A bar code reader on the machine and a bar coded label carried by the user, a ultrasonic or inferred receiver in the machine and a transmitter carried by the user, or any other number of variations that are common to the art could be used to accomplish this step.

At this point, a step is implemented that recognizes if the potential user is a current member 36. This can pertain to the person being in good standing in any of a number of aspects, including payment of the user's bill, or if they are a first time user. If they are a first time user, there is no valid user ID. A membership generation step 38 is initiated which sets up the basic information about the user including their name, address, training goals and a billing process. This billing process is likely a credit card number, but can also be a prepayment or deposit account that will be debited. A valid user ID is then generated for the user and a first billing step 40 is initiated. The logical placement of this billing step 40 is not critical. The system can function with a single billing step, likely at the end of the training session.

When an existing member logs on, the user's exercise protocol is loaded into the random access memory (RAM) of the device. This may entail downloading this information from a server, or in the case of a new member, a data file must be generated. This involves disc space and maintenance costs of the system. If the user does not finish the training session for any reason, the user would likely not be responsible for full payment, but since costs are incurred, the user's account is initially billed due to generating or accessing this information.

A step is then initiated which analyses as to the user having a valid exercise protocol 42. In the case of a new member or a member that has been absent for a prolonged period of time, a new or updated exercise protocol is generated 44. The generation of the protocol is highly dependent upon the desire of the user.

As previously discussed, there is scientific research to support different training methods for different desires for the user. In "weight training" both hypertrophy of the muscle (increased size) as well as increased strength and power will be realized by the user, but to different respects according to the training program. A bodybuilder (hypertrophy) trains differently than a power lifter (strength) who trains differently than a jumper or Olympic weight lifter (power) though each use the same basic tools, lifting weights. Endurance athletes and those training for reduced body fat will also train differently from any of the above. Therefore the exercise protocol is individually generated with the specific needs of the individual in mind. Upon generation of the protocol, there is a valid protocol, and the protocol is saved as Protocol "A" 46 to be used for user "A".

In general, "weight training" programs can also be developed for the person desiring general fitness improvement including hypertrophy and increased strength. This is done through the user's input of information about the user. This data includes: user's sex, age, weight, height and the number of times he or she exercises per week. Other information such as individual training goals can also be used. From this information a device specific algorithm generates the starting concentric and eccentric forces for each strength training device or relevant equivalent for each cardiovascular conditioning or stretching device.

The exercise protocol will be updated after each exercise session, in preparation for the next workout. As such, when a protocol is loaded, the logic system must determine whether the user is just starting or just finished an exercise sequence portion of that exercise session. Therefore a timing step 48 is used to distinguish as to the number of time intervals that have passed without activity of that device, thus indicating the end of that exercise sequence. Here it is shown that if the exercise sequence was completed within the past sixty seconds, the machine stops, being finished with that portion of the exercise protocol. The sixty-second increment is only an example and is not intended to be limiting. Any number of time increments can be used as deemed necessary.

If the exercise sequence has not been completed in the specified time frame the user's protocol 50 is loaded into the RAM of the microprocessor of the exercise device. The protocol is used as the exercise sequence is initiated and then completed 52. Upon completion of the exercise sequence, the user is then billed for the use of the exercise 54.

Data is generated from the sensors 56 associated with the exercise device or the user. This information is gathered during each exercise sequence. This data is processed by way of a protocol algorithm that is specific to that device and tailored to that individual user regarding their goals. Data gathered can vary according to the individual exercise device but will generally include performance data and/or physical data. Performance data includes range of motion, workload, duration and speed or some combination of these data. Physical data includes heart rate, blood pressure, body weight, body fat or any other common physical parameter. The product of this data, using the protocol algorithm, is a new exercise protocol 58, which then replaces the former protocol in preparation for the next exercise sequence for the next exercise session.

The protocol will be modified usually in the event of increased performance. The workload and/or duration will be increased to adequately tax the user during the next exercise session. Careful consideration is made to avoid overtraining. In most cases, where rates of increase in performance are greatly reduced, or even reversed, the training workload is decreased so as to allow the user to recuperate. Whether due to overtraining, injured, or illness, slight but consistent changes that are observed may result in protocol modifications for the user's safety and overall health. When performance values begin to increase as normal, the exercise level is progressively increased to properly stress the user's body to stimulate the desired response.

Figure 3:
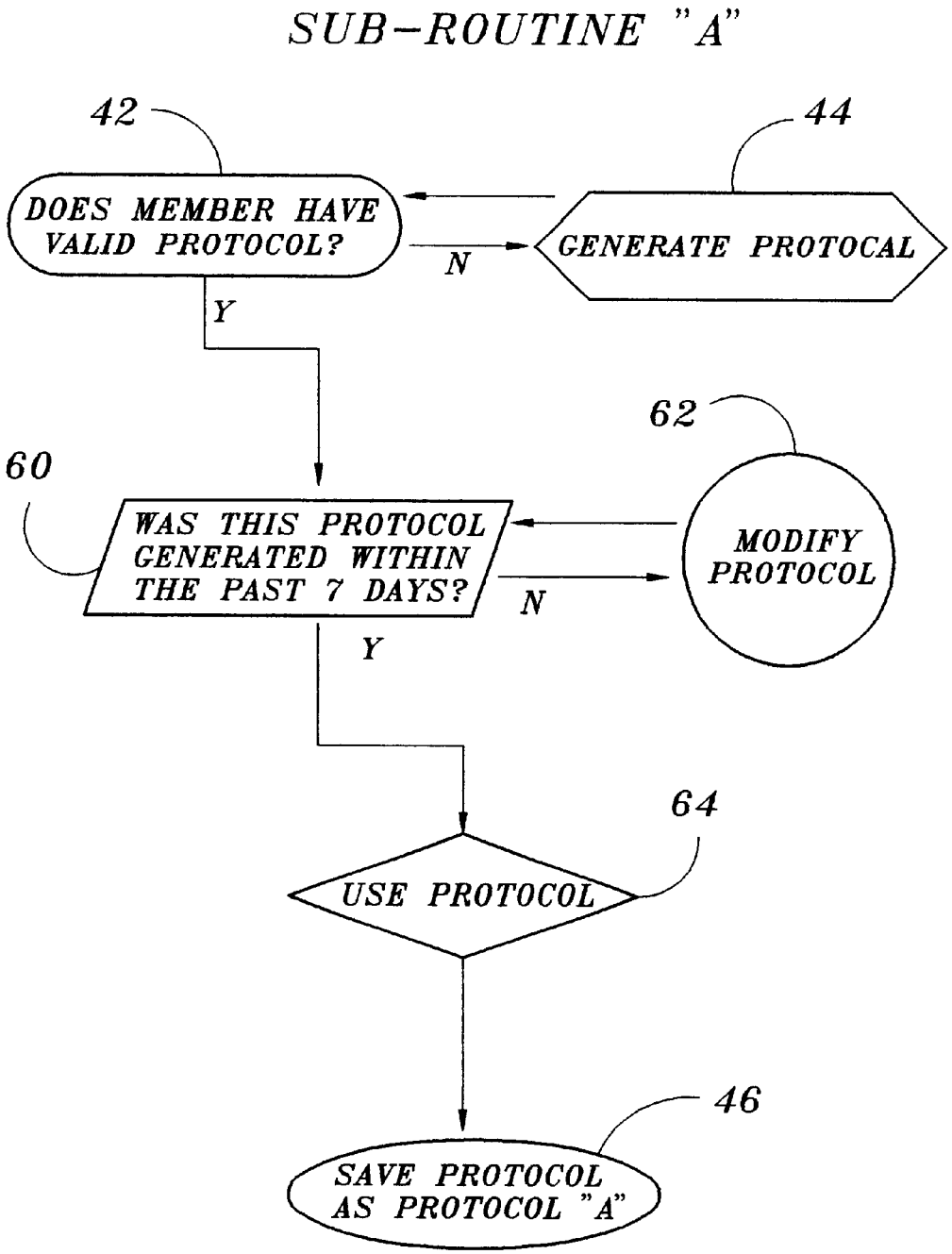
FIG. 3 is a flowchart illustrating the steps involved in validation or modification of an exercise protocol in view of the age of the protocol.

The step of generating a new protocol 58 is done after the completion of the exercise sequence step 52 in anticipation of the next exercise session. This is done to save processing time when the user returns for the next session. If the user delays for a prolonged period between exercise sessions the benefits gained from the previous exercise session will no longer be valid, unless the user has been undergoing physical training that is unknown to the system as described. To account for this situation, a subroutine "A" is shown in FIG. 3. Here between the identification of protocol validity 42 and saving of the protocol 46 as exist in the steps as shown in FIG. 2, are the logic steps that address this issue. After a valid protocol has been recognized 42 or generated 44 and then recognized 42, the age of the protocol is evaluated 60. Here a value of 7 days is used. If the protocol has not been used in one week or more, the user is assumed to be detrained and a modification algorithm 62 is employed. The term of seven days is not critical to the novelty of the disclosure, and is therefore not intended to be limiting.

If the user has been training on other equipment during this time away, a prompt can be initiated when the user is identified to the exercise device asking: "Where they have been". The modification algorithm 62 will take their activity into account is creating a new protocol 64. It is deemed better to cautiously reduce the load than to risk injury to the user. If the user did not detrain during the time off, even though the protocol will be modified in anticipation thereof, the sensory capability of the exercise device will rapidly detect the lack of detraining and rapidly increase the workload and/or duration of the exercise sessions accordingly.

Figure 4:
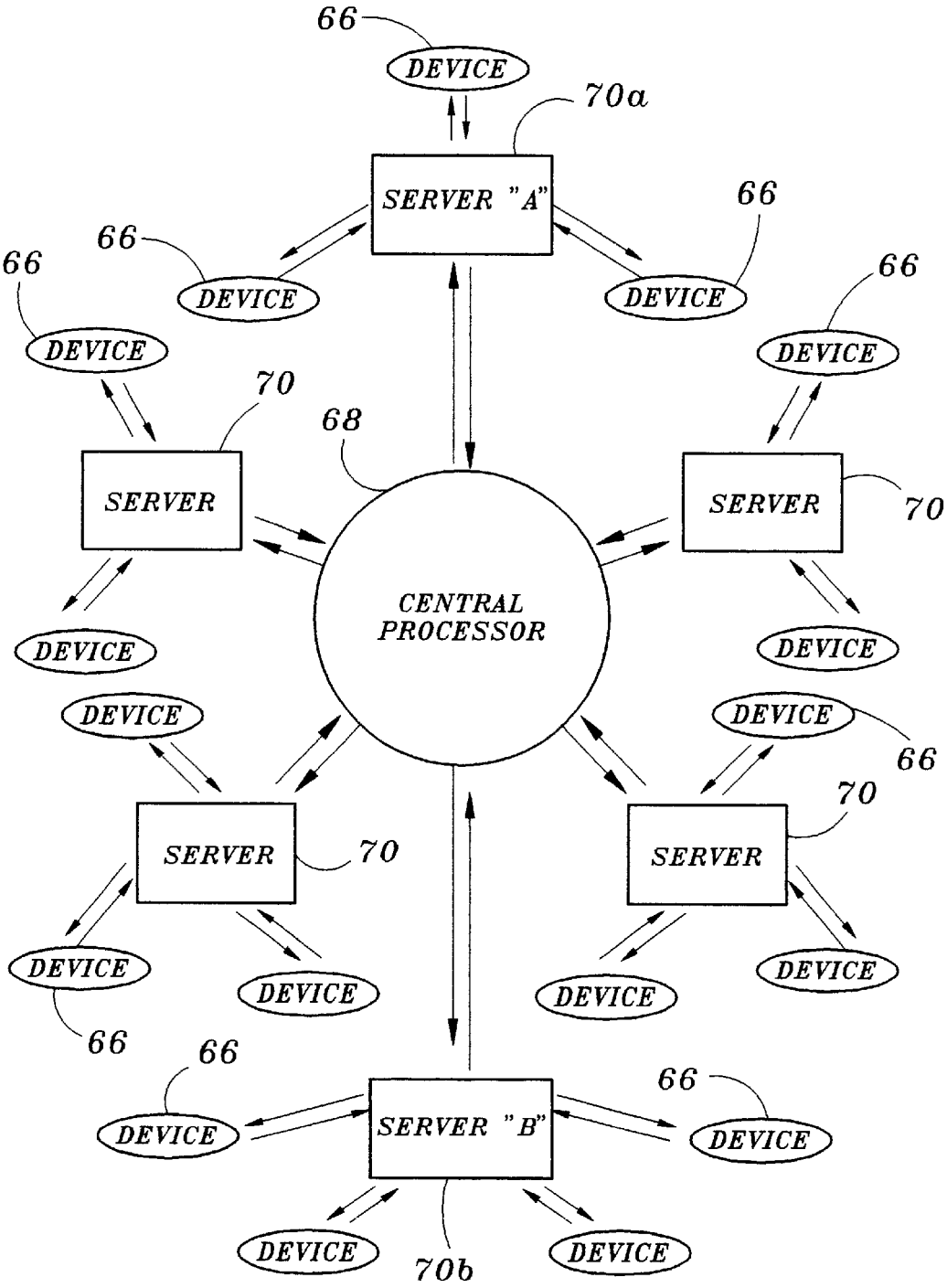
FIG. 4 is a graphical representation of the interaction of the system elements of the preferred embodiment of the present invention.

A global schematic view of the preferred embodiment of the disclosed is shown in FIG. 4. Multiple groups of individual exercise devices 66, each group can be located in different areas of a building or different parts of the world. A central processor 68 can store and transfer data to and from one or more localized servers 70. Each server 70, enabling data transfer to and from each exercise device 66.

In the preferred embodiment, the central processor 68 will communicate with each server 70 by means of an Internet connection or equivalent. This would allow the central processor 68 to be located in one part of the world and provide inexpensive data transfer access virtually anywhere by virtue of telephone or high-speed DSL lines. Each server 70 would preferably include a kiosk that is used to identify the user, set up a billing system (credit card number, deposit account, etc.), generate the user's initial exercise protocol and then feed this information to the individual exercise devices 66. The communication between the server 70 and each device 66 is preferably done by a local area network (LAN). The kiosk would instruct the user as to the first exercise device 66 they should use and upon completion of that exercise sequence, the display on the device 66 would instruct the user what action, if any, to be taken next. This could be to visit another device, if so which one, or if they are finished with this session, when they should return next.

Each exercise device 66 includes at least one sensor that generates data during each exercise sequence. Upon completion of the exercise sequence, this data is transferred to the server 70, which compiles all the data from the exercise session and generates a new protocol for the next exercise session based on this information. If deemed necessary this task of generation of the next exercise sequence portion of the protocol could be done at the device 66. It is preferable to perform this function at the server 70, due to greater processing power of the multitask functions of the server 70, and the desire to generate a new protocol based on the user's performance as a whole for that exercise session, not each sequence independently.

The server(s) 70 will update the central processor 68 at some time interval. This will preferably be done at regular time intervals, such as is commonly done with a data upload at off times, such as in the middle of the night. The central processor 68 stores this user performance information and compiles it into a format that is user-friendly, such as charts and graphs that plot the user's progress. The user can then access this information via an Internet connection or comparable system to view their individual progress.

The central processor 68 has the multiple function task of data computation, retrieval and transfer. If, for example, a user commonly uses the devices in direct communication with "Server A" 70*b* and travels to another location to use the devices at "Server B" 70*b*, since the user's up to date file is stored within the central processor 68, when the user identifies himself at "Server B" 70*b* and is not recognized, "Server B" 70*b* will access the central processor 68 to retrieve the user's current exercise protocol. If the user knows in advance that he will be traveling, he can access the central processor 68 via the Internet connection and alert the system that he will be utilizing "Server B" 70*b* on a specific date. During the data upload this information can then be transferred and waiting for him without accessing the central processor 68 while he waits.

Another method is for the user to store his/her up to date exercise protocol, or any other relevant information, on any device that is capable of electronic data storage, such as a magnetic strip or computer disk. The user can then download this critical information and take it with him and upload it into the system where the user travels.

Another function of the central processor 68 in this, the preferred embodiment, is the function of billing. When an individual machine is used alone, the billing system can be made analogous to that described here, but processed directly from the device itself or from the server, if used. This can take the form of credit card billing or a debit card where a reader is attached to the device, and processing a transaction as is common in the art, or using a coin slot or bill reader. In the preferred embodiment, the central processor 68 will take on this task. This is done by account billing through any of a number of systems common to the art. The most common is a credit card billing system where the billing sequences as previously disclosed are compiled and uploaded to the central processor 68 with the user's performance data. The respective accounts are totaled and accordingly billed at predetermined time or amount intervals.

Figure 5:
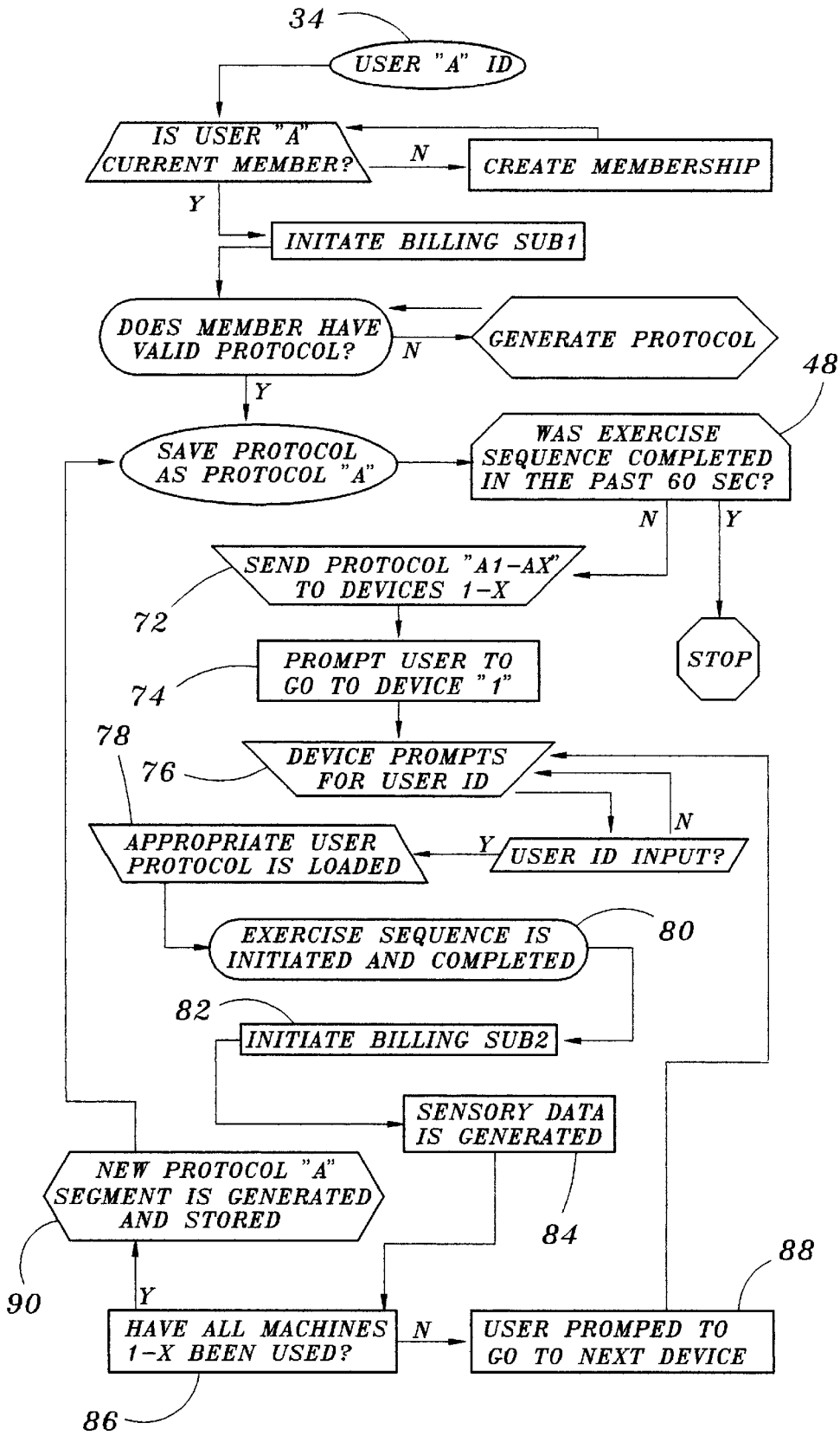
FIG. 5 is a flowchart illustrating the steps involved in the use of the process of controlling more than one exercise machine in a series in accordance with the preferred embodiment of the present invention.

The method as described previously, being expanded to include multiple exercise devices is shown in FIG. 5. Here all steps from the identification of the user 34 to the exercise sequence completion time step 48 are the same as those earlier disclosed in FIG. 2. With multiple devices, each portion of the protocol that pertains to each device is sent to the respective device 72. The user is then prompted to go to the first device in the user's protocol 74. This message is preferably presented to the user at the kiosk. This is also beneficial in that many times the user's routine can be altered to ease the flow of traffic through the devices, in the event that numerous people are using the devices at one time.

When the user approaches a device, his/her name will preferably appear on the display device. Numerous forms of identification can be used from touching the monitor in an area that denotes that user's name (touch screen) or any number of other procedures such as simply the user inputting their name or ID number into the device 76. This then identifies which protocol to be loaded 78 and be used for that exercise sequence.

When that exercise sequence is initiated and then completed 80, a billing routine is performed 82 for the use of that particular device. As before, sensory data is generated 84 from the sensors on the device and stored for later analysis. This storage can take place at the device but is preferably transferred to the server upon completion of the exercise sequence. Upon completion of the exercise sequence, the server tracks which machines have been used and which ones are yet to be used in accordance with the user's exercise protocol. At this point, an evaluation step is performed to assess as to whether all the devices have been used to complete the exercise session 86. If the session is not completed, the user is prompted, preferably by the monitor on that device, to go to the next device 88 within the bounds of that protocol. When the session is completed, all exercise sequences are completed, a new exercise protocol is generated and stored 90 in preparation for the next exercise session. This new protocol is, as previously disclosed, generated by a protocol algorithm for that user. The new protocol replaces the old protocol and is saved in memory.

Figure 6:
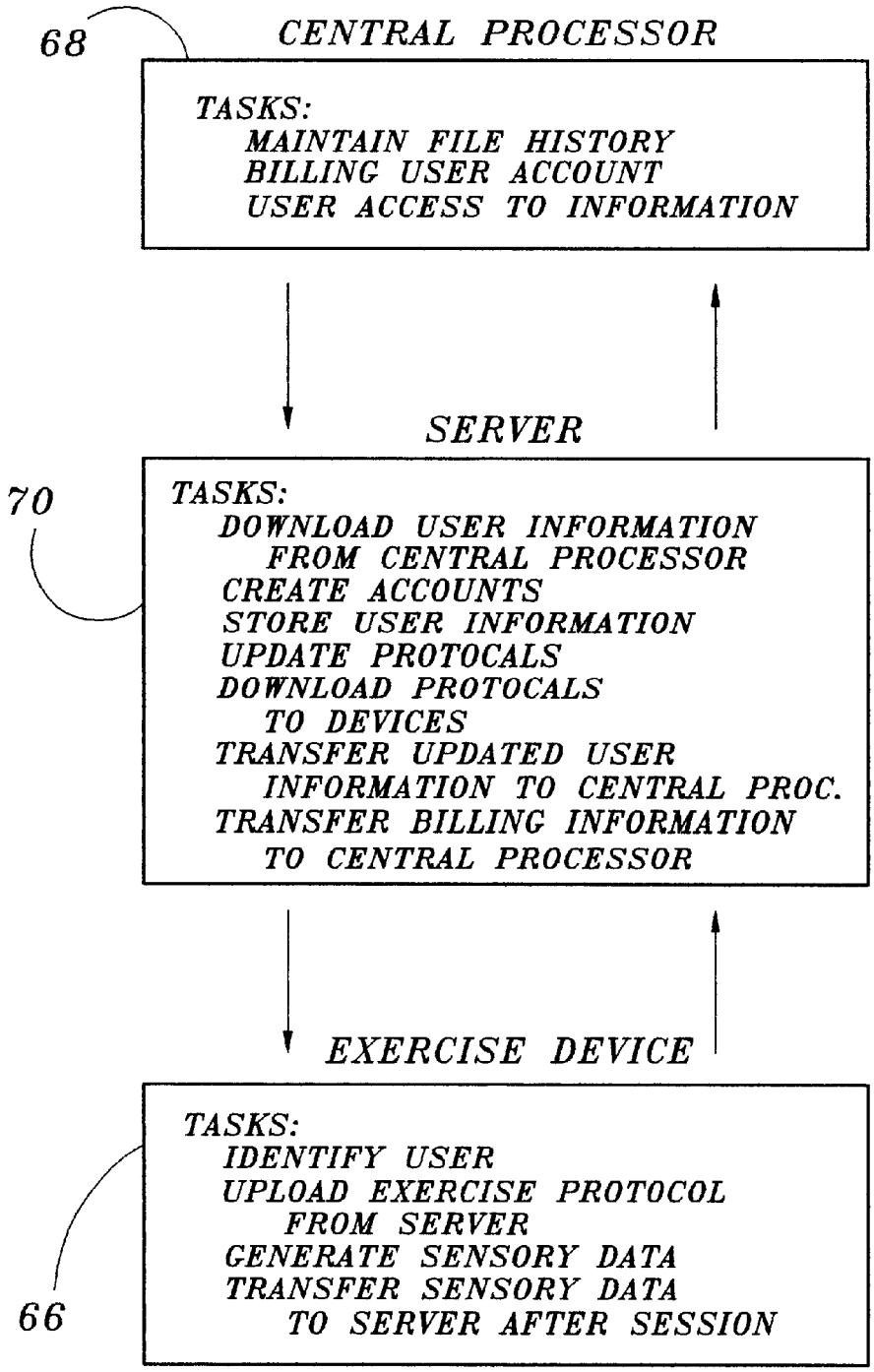
FIG. 6 is a flowchart illustrating the tasks of the system elements involved in the process of controlling at least one exercise machine in accordance with the preferred embodiment of the present invention.

Though it is not intended to be limiting to the scope of the invention, the preferred embodiment relating to the task responsibility is depicted in FIG. 6. These tasks could be performed by any number of combinations of devices. The server could be housed within one of the exercise devices or the central processor 68 could function as a server 70 as well. What is disclosed herein is in the interest of clarity, and is the preferred embodiment, as determined by the inventors.

The central processor 68 manages the file history of each individual, which includes compiling the user data in a user-friendly format that the user can access to view results and progress. The central processor 68 also is tasked with billing the user and keeping track of the user's account.

The server 70 is responsible for downloading the user's information from the central processor 68. This includes the user's current exercise protocol. The setup of new accounts will most likely be made through the kiosk portion of the server 70. This is not an absolute in that the user could access the central processor 68 by way of an Internet connection and set up the account before entering the facility where the server 70 is located.

The server 70 will be tasked with storing the user's training information such as current exercise protocols, and in this case, also their generation. In most cases the users will consistently use the same location repeatedly, therefore it is most advantageous concerning data transfer to store this information at the server 70 site. In cooperation with this task, it is most beneficial to update the exercise protocols at this site as well, thereby eliminating the need to transfer data from the server 70 to the central processor 68, where the protocol algorithm would generate a new exercise protocol, store a copy and then transfer a copy back to the server 70. The server 70 can perform this task and upload a copy of the bundled data from the day, all at one time. This is preferably done at off hours when the system is not otherwise in use. In terms of protocol generation, sensory data is gathered by the server 70, from the devices 66, and used to calculate the next exercise protocol.

The final use of the exercise protocols is at the exercise devices 66. Therefore the server is also responsible for downloading the up to date protocols to the appropriate devices when needed. Due to the higher cost of utilization of such technology as compared to a simple weight machine or other exercise device, the disclosed includes a novel pay-per-use method of payment for using the devices. This is similar to using a very high-tech personal trainer. One or more portions of the complete cycle of the exercise session is tallied by each device being used and the server 70. Upon completion of the session these "portions" of the bill are totaled at the server 70 and sent to the central processor 68 with the updated exercise protocol. This enables the central processor 68 to adequately perform an up to date billing process at regular intervals, be that daily, weekly, monthly or any other time increment or minimum billed amount.

The devices 66 obviously enable the exercise protocol to be performed by the user. As previously disclosed, the exercise protocol is downloaded from the server 70 to the individual devices 66. The sensory data is generated at the device 66 and uploaded to the server 70 after completion of the sequence thus enabling the server 70 to generate an up to date protocol.

Figure 7:
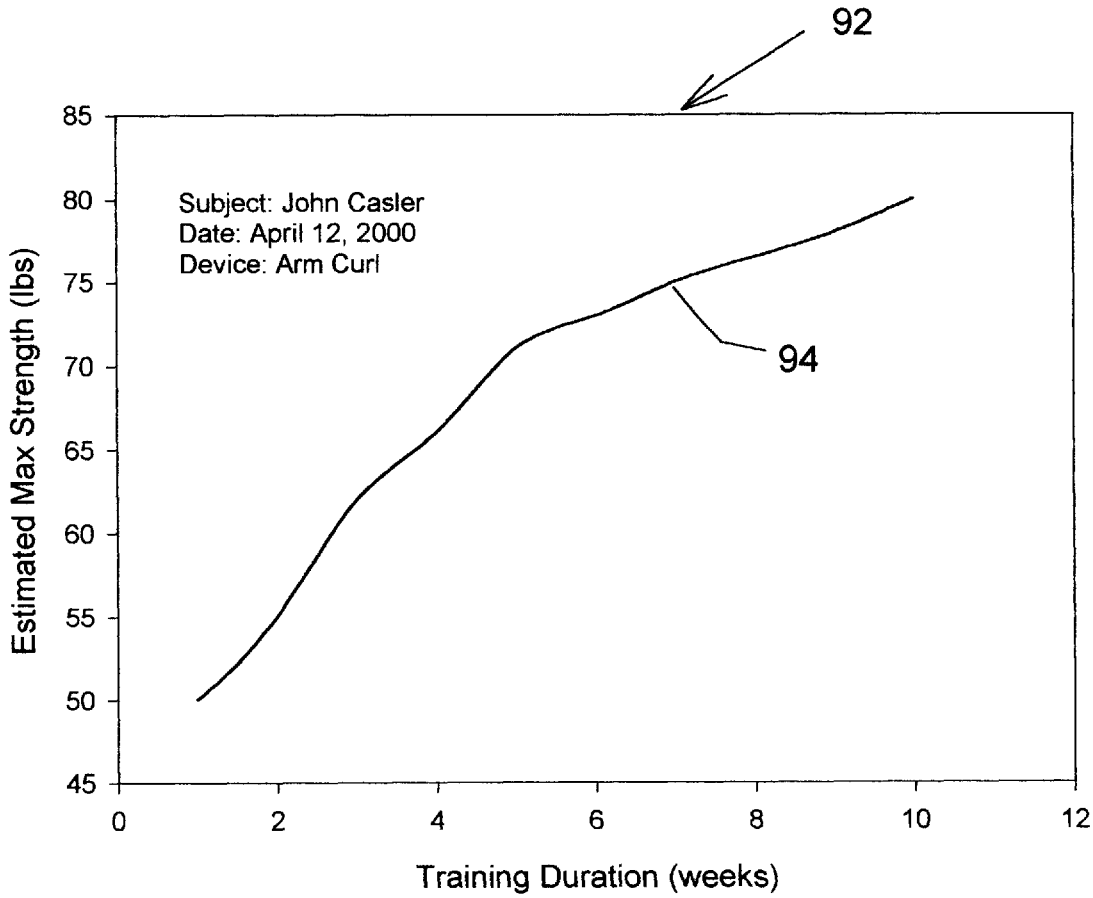
FIG. 7 is an example of motivational feedback in the form of a graph showing compiled user data regarding estimated max strength versus training duration.

What is shown in FIG. 7 is an example of user data presented in a user-friendly format 92. In general, user data is comprised of a form of performance data, physical data or any other data deemed relevant for the user. Here a subject's estimated maximal strength is displayed as a line 94 over training duration in weeks of training for a particular device. The strength can be calculated or measured in a variety of ways. Existing algorithms are used to estimate maximum one repetition maximum (1RM) strength. This is the maximum load that the user can lift in one concentric repetition. This is an accepted standard for strength measurement for a particular muscle group. The user can easily view the line 94 and denote an increase in muscular strength. This recognition of positive results motivates the individual to continue training.

Figure 8:
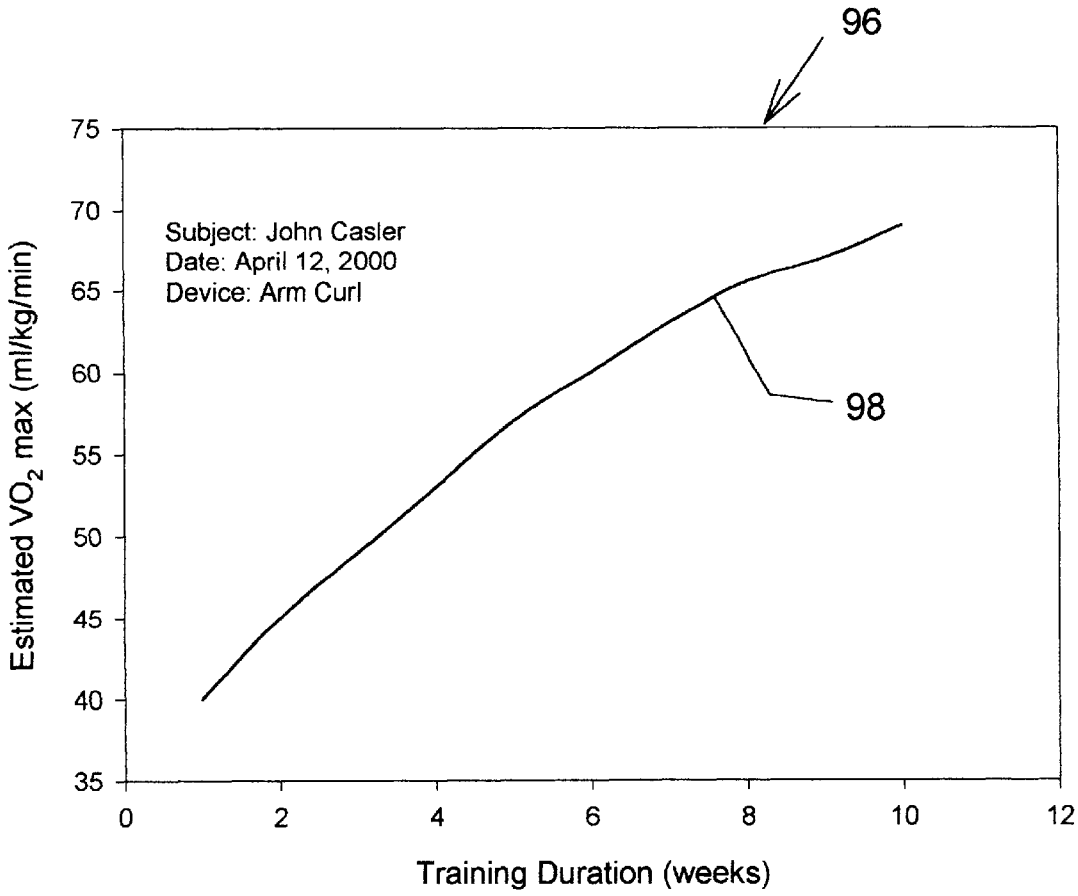
FIG. 8 is an example of motivational feedback in the form of a graph showing compiled user data regarding estimated cardiorespiratory fitness versus training duration.

In a similar manner FIG. 8 shows the relation of cardiorespiratory endurance versus training duration 96. Again, the curve 98 shows an increase in maximal estimated $VO_2$, or maximal oxygen uptake for a particular device, a treadmill. By measuring heart rate at a particular treadmill workload (inclination and speed) accepted standard estimations of maximal oxygen uptake can be made according to the American College of Sports Medicine (Blair, S. N., et al, 1986).

Figure 9:
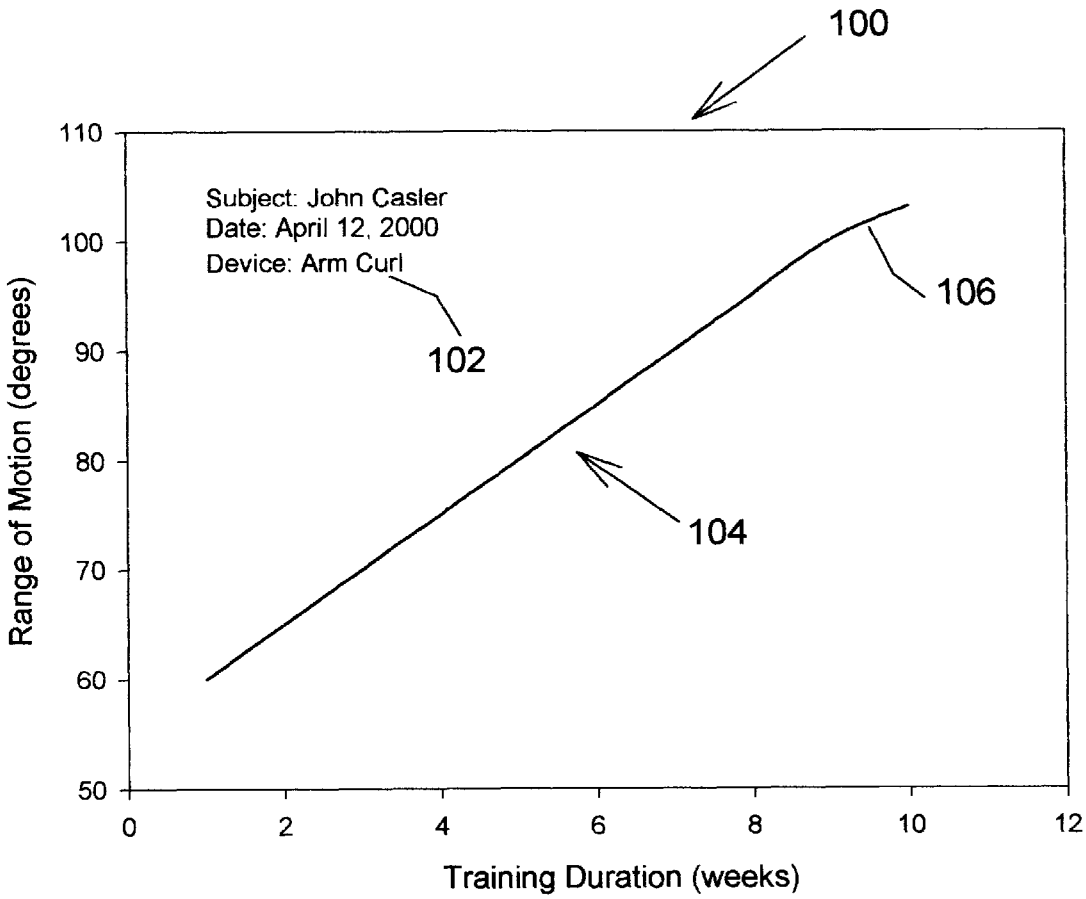
FIG. 9 is an example of motivational feedback in the form of a graph showing compiled user data regarding range of motion of a joint versus training duration.

Range of motion is also an important physiological consideration. Joint flexibility is a component of physical fitness, and can be incorporated into devices that specifically measure range of motion (ROM) of specific joints or combinations of joints. Another version would be especially advantageous in the area of rehabilitation after injury. What is shown in FIG. 9 is a ROM graph 100 with data taken from an arm curl machine 102. The curve 104 shows the increase in ROM over time. This signals the physician or therapist that healing is taking place at a level that is representative to the slope of the curve. The slope or first derivative of the curve can be evaluated at any time and compared to other therapies to compare protocols. The greater the slope value, the more rapid the recovery. Individual patients can also be observed as to a drop in the slope before what would be expected as near complete recovery. This would signal over exertion or potential re-injury. When the slope decreases near expected full recovery 106, this is a signal of near complete joint recovery.

Figure 10:
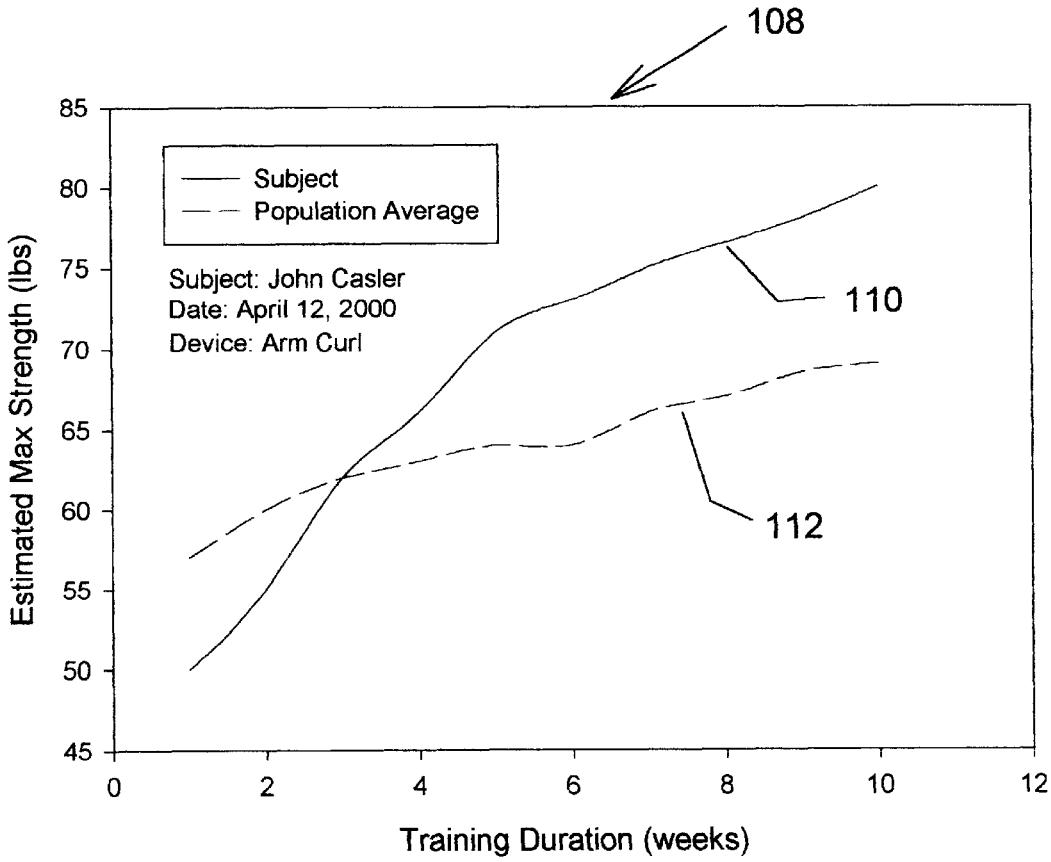
FIG. 10 is an example of motivational feedback in the form of a graph showing compiled user data regarding estimated max strength versus training duration for the user in relation to the mean value of all users.

Another method of comparison that is possible with this system is a comparison to the average or mean values of the population using any device. In FIG. 10 a comparison graph 108 is shown which shows the estimated maximal strength of the user 110 versus the mean values over time of the population 112. The user can then see that both themselves and the population as a whole have improved their strength over time. In addition, the user can easily see that though he started at a lower strength value than the average, his improvements have been greater than the average user, as denoted by the greater general slope of the curve denoting his gains.

These are only examples of the possible forms of data presented in a user-friendly format. As can be easily imagined, such information is both informative regarding an application to medical professionals as well as to motivate the user to continue using the exercise regime.

References

Blair, S. N., Gibbons, L. W., Painter, P., Pate, R. R., Taylor, C. B., and Will, J. *Guidelines for Exercise Testing and Prescription*, 3rd Edition, Lee & Febiger, Philadelphia, 160–169, 1986.

Budgett, R., Overtraining Syndrome, *Br. J. Sports Med.*, 24(4): 231–236, 1990.

Callister, R., Callister, R. J., Fleck, S. J. and Dudley, G. A., Physiological and performance responses to overtraining in elite judo athletes. *Med. Sci. Sports Exerc.*, 22(6): 816–824, 1990.

Fox, E. L., Bartels, R. L., Billings, C. E., Mathews, R. B. and Webb, W. M., Intensity and distance of interval training programs and changes in aerobic power. *Med. Sci. Sports Exerc.*, 5(1): 18–22, 1973.

Fox, E. L., Bartels, R. L., Klinzing, J. and Ragg, K., Metabolic responses to interval training programs of high and low power output. *Med. Sci. Sports Exerc.*, 9(3): 191–196, 1977.

Frick, M. H., Sjogren, A. L., Perasalo, J. and Pajunen, S., Cardiovascular dimensions and moderate physical training in younger men. *J. Appl. Physiol.* 29(4): 452–455, 1970.

Gollnick, P. D., Armstrong, R. B., Saltin, B., Saubert IV, C. W., Sembrowich, W. L. and Sheperd, R. E., Effect of training on enzyme activity and fiber composition of human skeletal muscle. *J. Appl. Physiol.* 34(1): 107–111, 1973.

Henriksson, J. and Reitman, J. S., Time course of changes in human skeletal muscle succinate dehydrogenase and cytochrome oxidase activities and maximal oxygen uptake with physical activity and inactivity. *Acta Physiol. Scand.* 99: 91–97, 1977.

Heyward, V. H., *Designs for Fitness*, Macmillan Publishing Co., New York, pp 4–6, 1984.

Karlsson, J., Nordesjo, L-O, Jorfeldt, L. and Saltin, B., Myuscle lactate, ATP, and CP levels during exercise after physical training in man. *J. Appl. Physiol.* 33(2): 199–203, 1972.

Schmidtbleicher, D. and Haralambie, G., Changes in contractile properties of muscle after strength training in man. *Eur. J. Appl. Physiol.* 46: 221–228, 1981.

Stone, M. H., O'Bryant, H. and Garhammer, J., A hypothetical model for strength training. *J. Sports Med.* 21: 342–351, 1981.

Warren, B. J., Stone, M. H., Kearney, J. T., Fleck, S. J., Johnson, R. L., Wilson, G. D. and Kraemer, W. J., Performance measures, blood lactate and plasma ammonia as indicators of overwork in elite junior weightlifters. *Int. J. Sports Med.* 13: 372–376, 1992.

What is claimed is:

1. An exercise method including the steps of:

(A) providing an exercise device and at least one sensor, said exercise device being adapted to enable information transfer between a user and said exercise device;

(B) identifying said user;

(C) providing an exercise protocol for said user;

(D) controlling said exercise device in accordance with said exercise protocol;

(E) generating data from said at least one sensor;

(F) generating a new protocol in view of said data generated from at least one sensor;

(G) replacing said exercise protocol with said new protocol and;

(H) billing said user for use of said exercise device.

2. The method as described in claim 1, wherein step (F) further comprises utilizing a protocol algorithm to generate said new protocol.

3. The method as described in claim 1, wherein said data from said at least one sensor includes the user's performance data from the exercise session.

4. The method as described in claim 3, wherein said user's performance data includes data selected from the group consisting of range of motion, workload, exercise duration and speed a portion of the exercise device.

5. The method as described in claim 1, wherein said data from said at least one sensor includes the user's physical data.

6. The method as described in claim 5, wherein said user's physical data includes data selected from the group consisting of heart rate, blood pressure, bodyweight and body fat.

7. The method as described in claim 1, wherein said step of billing said user includes more than one partial billing sequence.

8. The method as described in claim 1, further comprising initiating a first billing sequence after the step (B) and a second billing sequence after step (D).

9. The method as described in claim 1, wherein step (C) is further comprised (1) verification of a valid user exercise protocol; and (2) generating a valid user protocol if necessary.

10. The method as described in claim 9, wherein step (2) further comprises the steps of:

(a) identifying said user's sex;

(b) identifying said user's age;

(c) identifying said user's weight;

(d) identifying said user's height;

(e) identifying a number of times per week said user exercises; and (f) calculating a starting force for said exercise protocol from the data gathered from steps (a) through (e).

11. The method as described in claim 9, further comprising the steps of:

(3) evaluating exercise protocol age; and (4) modifying exercise protocol if said protocol is older than predetermined value.

12. The method as described in claim 11, wherein said predetermined value is seven days.

13. The method as described in claim 1, further comprising the steps of:

(H) providing a multi-accessible information transfer system in communication with said exercise device;

(I) retrieving said data from said at least one sensor;

(J) compiling said data in a user-friendly format, thereby creating user data;

(K) uploading said user data to said multi-accessible information transfer system; and (L) providing access by said user to said user data.

14. The method as described in claim 13, further comprising periodically updating said user data and maintaining current user data.

15. The method as described in claim 1, further comprising the step of:

(H) enabling a technician to modify said exercise protocol.

16. An exercise method including the steps of:

(A) providing a plurality of exercise devices and at least one sensor, said exercise devices being adapted to enable information transfer between a user and said exercise devices;

(B) identifying said user;

(C) providing an exercise protocol for said user;

(D) controlling each of said exercise devices in accordance with said exercise protocol;

(E) generating data from said at least one sensor of each of said exercise devices used;

(F) compiling said data from at least one sensor from each of said exercise devices used;

(G) generating a new protocol in view of said data compiled from said at least one sensor from each of said exercise devices used;

(I) replacing said exercise protocol with said new protocol; and (J) billing said user for use of said exercise devices.

17. The method as described in claim 16, wherein step (G) further comprises utilizing a protocol algorithm to generate said new protocol.

18. The method as described in claim 16, wherein said data from said at least one sensor includes the user's performance data from the exercise session.

19. The method as described in claim 18, wherein said user's performance data includes data selected from the group consisting of range of motion, workload, exercise duration and speed a portion of the exercise device.

20. The method as described in claim 16, wherein said data from said at least one sensor includes the user's physical data.

21. The method as described in claim 20, wherein said user's physical data includes data selected from the group consisting of heart rate, blood pressure, bodyweight and body fat.

22. The method as described in claim 16, wherein said step of billing said user includes more than one partial billing sequence.

23. The method as described in claim 16, further comprising initiating a first billing sequence after the step (B) and a second billing sequence after step (D).

24. The method as described in claim 16, wherein step (C) is further comprised of:

(1) verification of a valid user exercise protocol; and (2) generating a valid user protocol if necessary.

25. The method as described in claim 24, wherein step (2) further comprises the steps of:

(a) identifying said user's sex;

(b) identifying said user's age;

(c) identifying said user's weight;

(d) identifying said user's height;

(e) identifying a number of times per week said user exercises; and (f) calculating a starting force for said exercise protocol from the data gathered from steps (a) through (e).

26. The method as described in claim 24, further comprising the steps of:

(3) evaluating exercise protocol age; and (4) modifying exercise protocol if said protocol is older than predetermined value.

27. The method as described in claim 26, wherein said predetermined value is seven days.

28. The method as described in claim 16, further comprising the steps of:

(I) providing a multi-accessible information transfer system in communication with said exercise devices;

(J) retrieving said data from said at least one sensor on each of said exercise devices;

(K) compiling said data in a user-friendly format, thereby creating user data;

(L) uploading said user data to said multi-accessible information transfer system; and (M) providing access by said user to said user data.

29. The method as described in claim 28, further comprising periodically updating said user data and maintaining current user data.

30. The method as described in claim 16, further comprising the step of:

(H) enabling a technician to modify said exercise protocol.

* * * * *